US005746371A

United States Patent [19]

Ben-Haim

[11] Patent Number: 5,746,371

[45] Date of Patent: May 5, 1998

[54] CUTTING BRICK FOLDING CARTON AND BLANK

[76] Inventor: Amit Ben-Haim, 55 Park Lane, Suite 12, London W1Y 3DH, United Kingdom

[21] Appl. No.: 581,075

[22] Filed: Dec. 29, 1995

[51] Int. Cl.[6] ..... B65O 5/54

[52] U.S. Cl. ..... 229/222; 229/121; 229/122

[58] Field of Search ..... 229/121, 122, 229/222, 225, 226, 227, 902, 905, 906

[56] References Cited

U.S. PATENT DOCUMENTS

| | | | |
|---|---|---|---|
| 2,218,509 | 10/1940 | Goodyear | 229/905 |
| 2,342,198 | 2/1944 | Hultin . | |
| 2,785,845 | 3/1957 | Stenger | 229/902 |
| 2,894,674 | 7/1959 | Wagaman | 229/222 |
| 3,168,974 | 2/1965 | Buttery et al. . | |
| 3,219,357 | 11/1965 | Anderson . | |
| 3,263,899 | 8/1966 | Collura et al. | 229/222 |
| 3,281,059 | 10/1966 | Buttery et al. . | |
| 3,295,743 | 1/1967 | Redpath et al. . | |
| 3,315,870 | 4/1967 | Barnes . | |
| 3,361,328 | 1/1968 | Buttery . | |
| 3,379,361 | 4/1968 | Barnes | 229/121 |
| 3,524,581 | 8/1970 | Buttery . | |
| 3,648,921 | 3/1972 | Lock | 229/222 |
| 3,735,916 | 5/1973 | Buttery . | |
| 3,833,165 | 9/1974 | Hoiles . | |
| 3,981,434 | 9/1976 | Ramich . | |
| 4,339,041 | 7/1982 | Roberts et al. | 229/222 |
| 4,756,470 | 7/1988 | DePaul . | |
| 4,838,432 | 6/1989 | DePaul . | |
| 4,907,698 | 3/1990 | Konrad et al. . | |
| 5,033,622 | 7/1991 | DePasquale et al. . | |
| 5,288,012 | 2/1994 | DeMay . | |
| 5,351,881 | 10/1994 | DeMay . | |
| 5,409,160 | 4/1995 | DeMay . | |
| 5,474,231 | 12/1995 | Froom . | |
| 5,484,102 | 1/1996 | DeMay . | |

FOREIGN PATENT DOCUMENTS

| | | | |
|---|---|---|---|
| 1419392 | 10/1965 | France | 229/222 |

*Primary Examiner*—Gary E. Elkins

*Attorney, Agent, or Firm*—Seidel, Gonda, Canorgna & Monaco, PC

[57] ABSTRACT

A blank for forming a cutting brick carton is provided. The blank comprises cover, top, rear, bottom and front panels hingedly connected in the order named. End wall-forming flaps are hingedly connected to bottom and top ends of the main panels. Perforations on the cover panel and top panel end flaps provide improved accessibility, re-closability and appearance.

2 Claims, 4 Drawing Sheets

CUTTING BRICK FOLDING CARTON AND BLANK

BACKGROUND OF THE INVENTION

1. Field of Invention

The present invention relates generally to folding paperboard cartons, and more particularly to an improved carton blank for use in assembling a carton having improved accessibility, re-closability and appearance.

2. Brief Description of the Prior Art

Folding cartons are well known in the packaging art. These cartons are constructed from flat blanks which are pre-cut and pre-scored on paperboard sheets. Carton blanks have four main panels which are adapted to form the top, rear, bottom and front of an assembled carton. Each panel has a pair of end flaps which are hingedly connected by score lines formed in the paperboard.

The blanks are folded once and secured with known adhesives to form carton sleeves which are used for packaging retail products, typically consumable goods. During the filling operation, packaging machinery is used to form and seal fully assembled cartons according to a prescribed folding sequence and adhesive pattern.

U.S. Pat. No. 5,288,012 describes a state-of-the-art carton blank used to assemble a rectangular, top opening carton. First and second ends of the carton are closed by folding the bottom panel end flaps first; front panel end flaps second; top panel end flaps third and rear panel end flaps fourth and last.

Prior to folding in the fourth down flap, single lines of adhesive are deposited on the bottom panel end flaps. All four end flaps are secured by single glue lines to form a smooth, continuous wall at first and second ends of the carton.

Carton blanks are typically produced on large paperboard sheets in a multiple configuration. Individual blanks are internally "nested" on three sides to minimize the amount of excess or wasted paperboard. During the blanking operation, score lines are provided to facilitate the flap-folding sequence. Perforations are also cut in the paperboard to form art-recognized tear-away and breakaway features like those described in U.S. Pat. No. 4,712,689. Perforations and score lines are formed by die-cutting and die-stamping the carton blanks in a single, downward direction.

OBJECTS OF THE INVENTION

Accordingly, it is a general object of the present invention to provide improvements in a carton for packaging materials.

It is another object of the present invention to provide a carton blank which has improved accessibility through use of perforations cut in the paperboard to form multiple tear-away features formed by a simple blanking operation.

Another object of the invention is to provide a carton blank which has improved re-closability through use of perforations cut in the paperboard to form multiple tear-away strips and pockets, formed by a simple blanking operation. Another object of the invention is to provide a carton blank which is adapted to construct a leak-proof carton and which carton is tamper evident after sealing.

It is yet another object of the present invention to provide a carton blank for forming a carton having a low profile, and a more, overall, aesthetically pleasing appearance.

Still further objects of the present invention will be apparent to those skilled in the relevant art.

SUMMARY OF THE INVENTION

According to one aspect of the present invention, a blank for forming a carton is provided. The blank includes front, bottom, rear and top panels which are hingedly connected by score lines and adapted to form a corresponding sleeve which is readily converted into an open-ended carton, closed at one end, filled with a selected product and closed at the other end in a manner well-known in the art.

Each main panel has first and second end flaps which are hingedly connected at bottom and top ends. Score lines are disposed between the main panels and their respective end flaps. Optional lips or membranes are hingedly connected to the top edge of the front panel end flaps of the carton blank. Releasable tear strips are formed in the top panel end flaps by perforations in the paperboard stock.

The blank also includes a cover panel portion hingedly connected to the top panel and adapted to overlap the front panel. In one embodiment, a releasable tear strip is also formed on the cover panel portion by perforations in the paperboard stock.

As an important aspect of the present invention, score lines and perforations are formed by die-cutting or die-stamping the carton blanks in a single, downward, uniform direction.

Reference is now made to the following detailed description of the preferred embodiments in connection with the accompanying drawings. Additional disclosure is provided by U.S. Pat. Nos. 5,288,012, 5,351,881 and 5,409,160, which are all incorporated by reference in this specification.

DESCRIPTION OF THE PREFERRED EMBODIMENT

Figure 1:
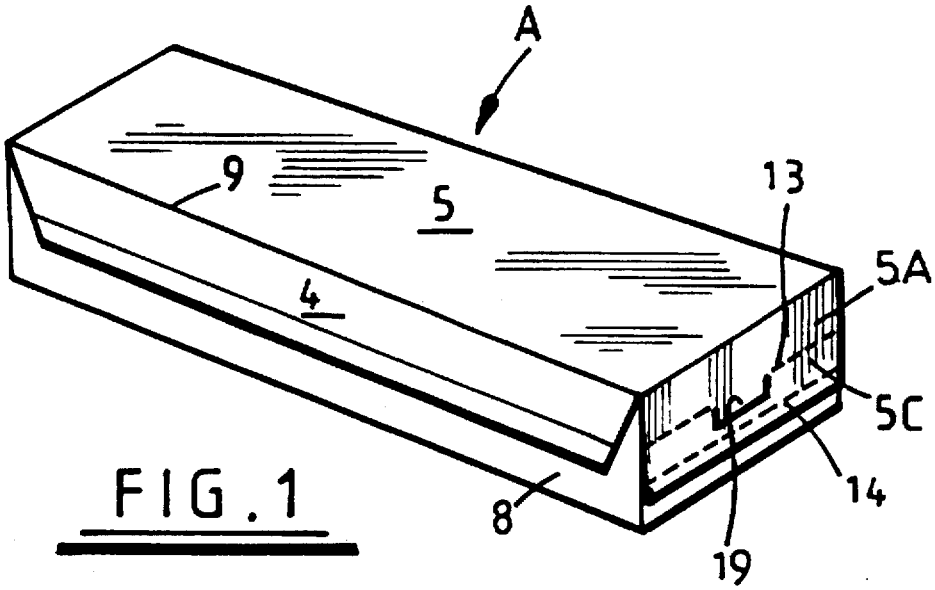
FIG. 1 is a perspective view of a flat carton formed in accordance with one embodiment of the present invention and shows the low profile, aesthetically pleasing appearance in the form of a "cutting brick"

Referring to the embodiment of the invention illustrated in FIG. 1, a flat carton generally designated A is shown with top panel 5, cover panel 4 and front panel 8. One end of carton A is shown generally in the drawings with top panel 5 contiguous with end flap 5A on which is shown tear-away strip 5C. Strip 5C is defined by upper and lower die-cuts or perforations 13 and 14. Also shown on end flap 5A is lip portion 19.

Figure 2:
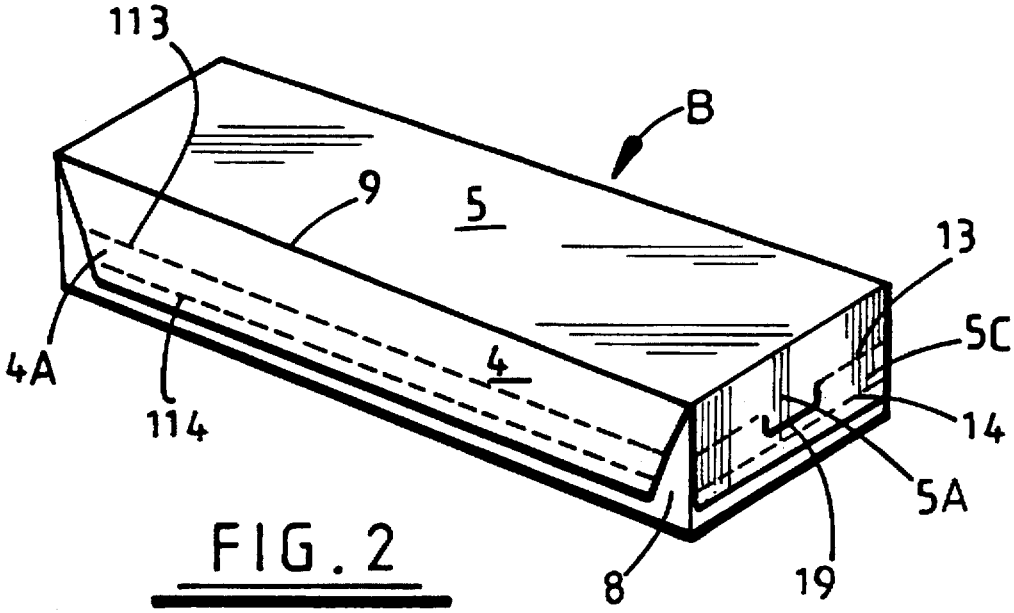
FIG. 2 is a perspective view of a flat carton formed in accordance with another embodiment of the present invention.

Similarly, FIG. 2 depicts a flat carton generally designated B shown with top panel 5 contiguous with end flap 5A on which is formed tear-away strip 5C defined by upper and lower perforations 13 and 14. Additionally, cover panel 4 is depicted as having tear-away strip 4A defined by upper and lower perforations 113 and 114.

Figure 3:
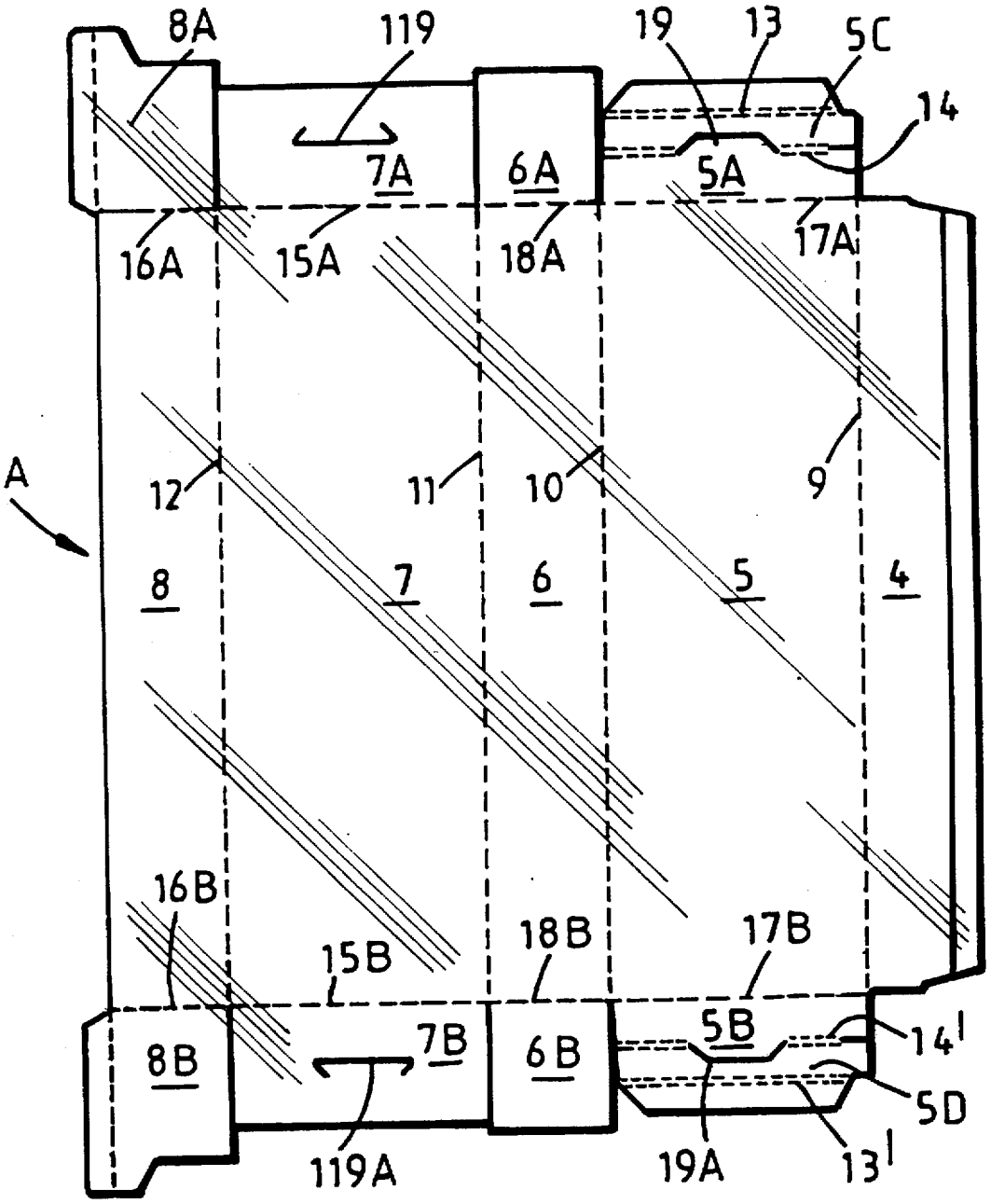
FIG. 3 is a plan view of a flat carton blank formed in accordance with one embodiment of the present invention.

Referring to FIG. 3, a carton blank is shown designated A and comprises cover panel 4, top panel 5, rear panel 6, bottom panel 7 and front panel 8 hingedly connected in the order named. More specifically, cover panel 4 and top panel 5 are hingedly connected by score line 9; top panel 5 and rear panel 6 are hingedly connected by score line 10; rear panel 6 and bottom panel 7 are hingedly connected by line 11 and bottom panel 7 and front panel 8 are hingedly connected by score line 12. Each score line is formed in the downward direction with reference to the upper surface of blank A.

Along with other aspects of the present invention, score lines 9–12 permit simple manipulation of blank A to form an assembled carton for universal packaging of pre-selected products.

As shown generally in the drawings, top panel 5 includes first and second end flaps 5A and 5B on which are formed tear-away strips 5C and 5D, respectively. Strip 5C is defined by upper and lower die-cuts or perforations 13 and 14, while strip 5D is defined by perforations 13' and 14'. Lip portions 19 and 19A are also shown on end flaps 5A and 5B. Bottom panel 7 includes first and second end flaps 7A and 7B on which are cut pockets 119 and 119A, respectively.

In the assembled carton, lip portions 19 and 19A on top panel end flaps 5A and 5B can engage pockets 119 and 119A on bottom panel end flaps 7A and 7B, respectively. This feature allows re-closability of either or both end flaps 5A and 5B after either strips 5C and/or 5D have been removed. Pockets 119 and 119A on bottom panel end flaps 7A and 7B are cut in the same blanking operation as with the formation of score lines 9–12, and along with die-cuts 13, 13', 14 and 14', are all formed in a downward direction with reference to the upper surface of blank A.

Main panels 4–8 have first and second end flaps hingedly connected by adjacent fold lines. Specifically, first and second bottom panel end flaps 7A and 7B are hingedly connected to bottom panel 7 by intermediate fold lines 15A and 15B, respectively. In like terms, first and second front panel end flaps 8A and 8B are hingedly connected to front panel 8 by intermediate fold lines 16A and 16B; first and second top panel end flaps 5A and 5B are hingedly connected to top panel 5 by intermediate fold lines 17A and 17B; and first and second rear panel end flaps 6A and 6B are hingedly connected to rear panel 6 by intermediate fold lines 18A and 18B.

Figure 4:
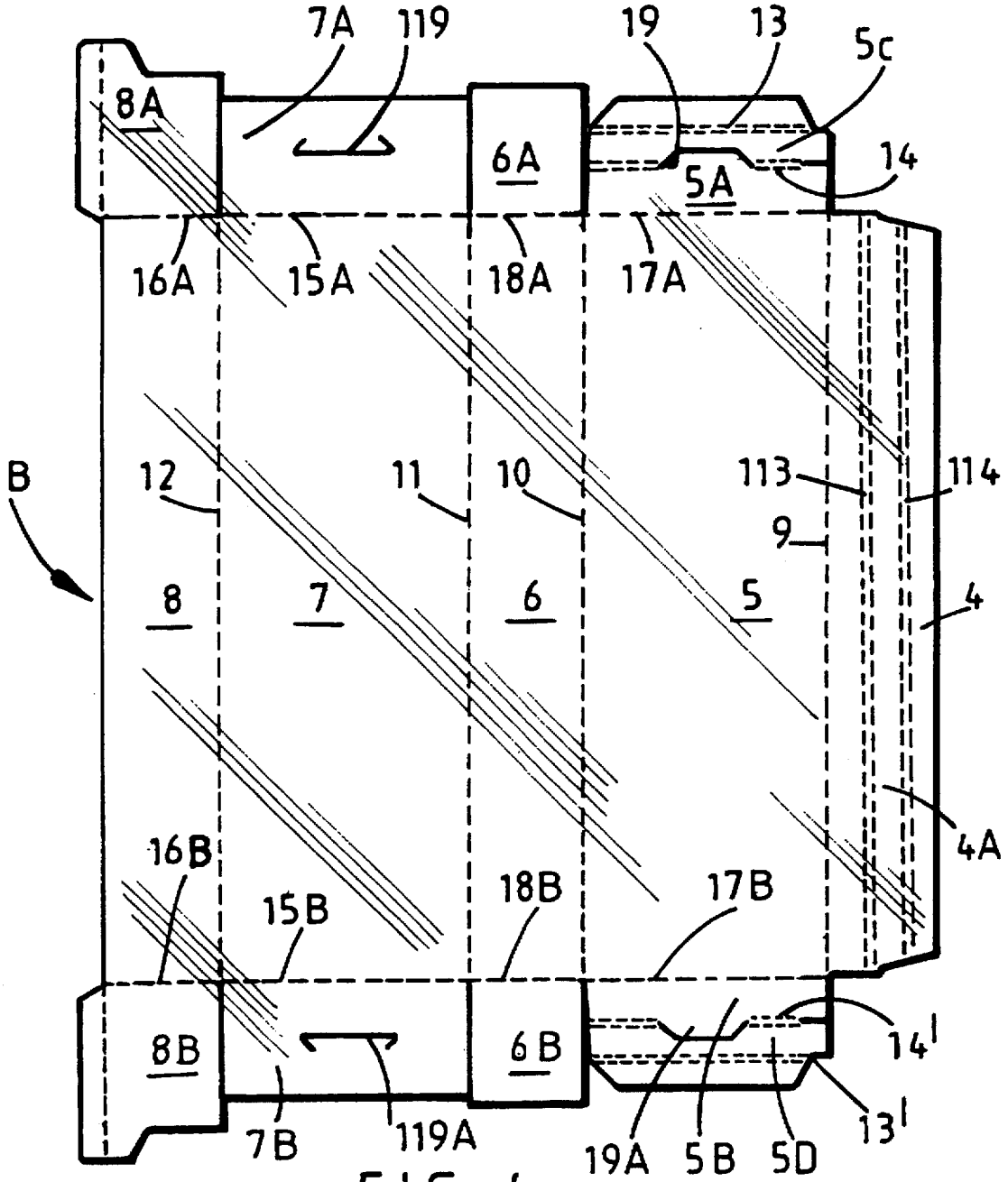
FIG. 4 is a plan view of a flat carton blank formed in accordance with the embodiment shown in FIG. 2.

FIG. 4 depicts a carton blank generally designated B and is shown having cover panel 4 on which is formed tear-away strip 4A defined by upper and lower perforations or die-cuts 113 and 114. Cover panel 4 is hingedly connected to top panel 5 via score line 9. Die-cuts 113 and 114, and score line 9 are cut/scored in the same blanking operation in a downward direction with reference to the upper surface of blank B.

Figure 5A:
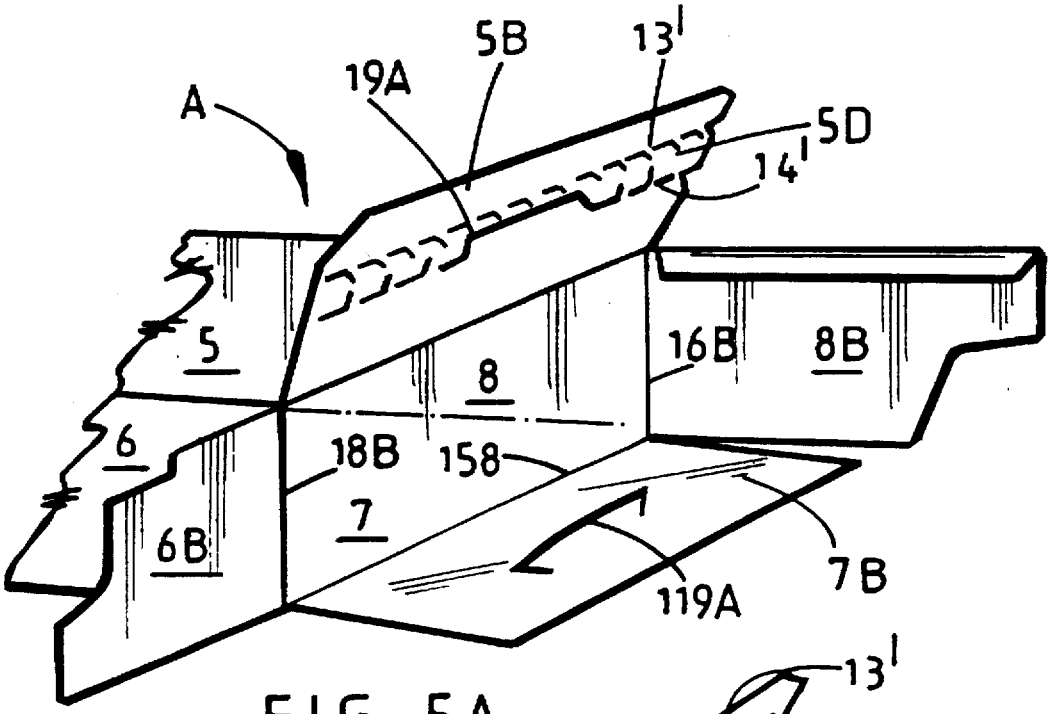
FIGS. 5A and 5B are fragmentary, perspective views of one end of the carton during the folding sequence.
Figure 5B:
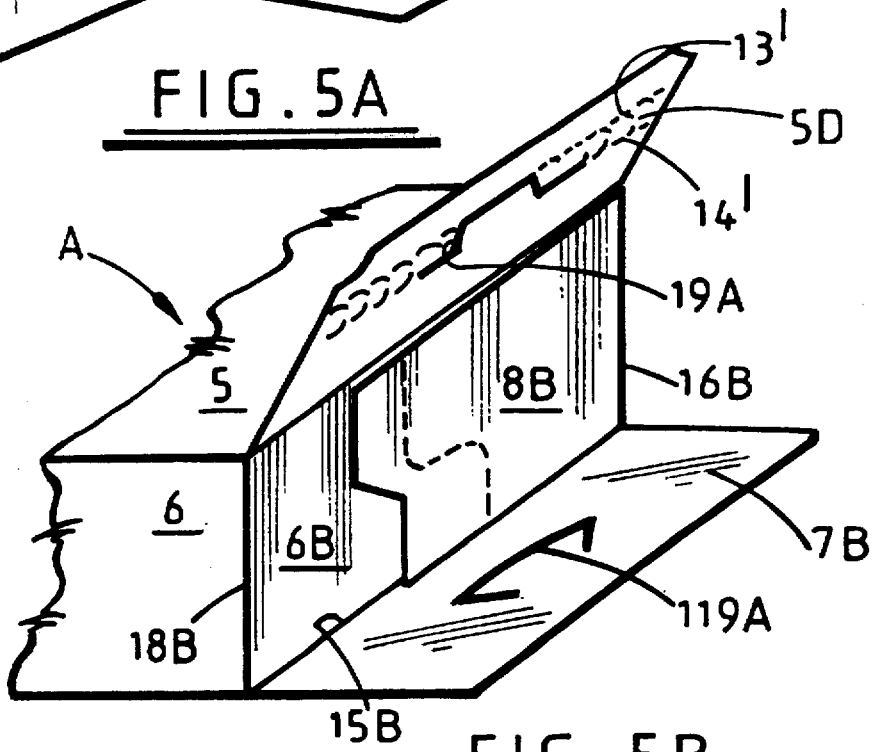

As shown in greater detail by FIGS. 5A and 5B, carton blank A is partially assembled by arranging rear panel end flap 6B, front panel end flap 8B, bottom panel end flap 7B and top panel end flap 5B according to the following flap folding sequence. Rear panel end flap 6B is first folded along score line 18B; front panel end flap 8B is next folded along score line 16B (as shown in FIG. 5B) and bottom panel end flap 7B is then folded along score line 15B to contact rear panel end flap 6B and front panel end flap 8B. Tear-away strip 5D is next releasably secured to bottom panel end flap 7B by adhesives along end flap 5B.

Additional features of the present invention will now be described. Using blank B, a carton is assembled by first forming an intermediate carton sleeve. Cover panel 4 of blank A is folded along score line 9 to overlie a portion of front panel 8. Glue is then applied to the interior side of cover panel 4 or the exterior side of front panel 8 with care being taken to avoid the interior side of tear strip 4A. Cover panel 4 is applied to front panel 8 to form a carton sleeve.

A carton is formed from this partially assembled sleeve. First, the sleeve is squared-up to form an open-ended carton. To accomplish this, the rear panel end flap 6A is first folded along score line 18A; front panel end flap 8A is next folded along score line 16A and bottom panel end flap 7A is then folded along score line 15A to engage rear panel end flap 6A and front panel end flap 8A. Glue is then applied to the interior side of top panel end flap 5A or the exterior side of bottom panel end flap 7A with care being taken to avoid the interior side of tear strip 5C. Top panel end flap 5A is applied to bottom panel end flap 7A forming the open-ended carton.

During a typical filling operation, preselected solid or semi-solid products such as candy, ice cream, snack chips, novelty items and the like are delivered to the receptacle formed by the open-ended carton. After appropriate filling, the carton is finally assembled by folding rear panel end flap 6B first along score line 18B; front panel end flap 8B is next folded along score line 16B and bottom panel end flap 7B is then folded along score line 15B to contact rear panel end flap 6B and front panel end flap 8B. Tear-away strip 5D is next releasably secured to bottom panel end flap 7B by adhesives along end flap 5B.

Various modifications and alterations to the present invention may be appreciated based on a review of this disclosure. These changes and additions are intended to be within the scope and spirit of this invention as defined by the following claims.

What is claimed is:

1. A blank for assembling a cutting brick folding carton which comprises:

(a) cover, top, rear, bottom and front panels hingedly connected in the order named, said panels having bottom and top ends, said cover panel having a first set of perforations defining a first tear-away strip;

(b) first and second front panel end flaps hingedly connected to said bottom and top ends of said front panel;

(c) first and second bottom panel end flaps hingedly connected to said bottom and top ends of said bottom panel, said first bottom panel end flap having a first die-cut pocket and said second bottom panel end flap having a second die-cut pocket;

(d) first and second rear panel end flaps hingedly connected to said bottom and top ends of said rear panel; and (e) first and second top panel end flaps hingedly connected to said bottom and top ends of said top panel, said first top panel end flap having a second set of perforations defining a second tear-away strip and a first lip portion and said second top panel end flap having a third set of perforations defining a third tear-away strip and a second lip portion; wherein the blank is adapted to form an intermediate carton sleeve having top and bottom end openings, said rear panel end flaps are folded first, said front panel end flaps are folded second to overlie a portion of said rear panel end flaps, said bottom panel end flaps are folded third and said top panel end flaps are folded fourth so that said top panel end flaps are operably associated with said bottom panel end flaps and said top and bottom end openings are substantially closed.

2. The blank of claim 1, wherein said first lip portion of said first top panel end flap is adapted to engage said first die-cut pocket, and said second lip portion of said second top panel end flap is adapted to engage said second die-cut pocket.

* * * * *